US006494771B2

(12) United States Patent
Carlson

(10) Patent No.: US 6,494,771 B2
(45) Date of Patent: Dec. 17, 2002

(54) SANDING BOARD HAVING CONFIGURABLE, CONTOURABLE BASE

(76) Inventor: Gerald Carlson, 700 Wagner La., Kalispell, MT (US) 59901

( * ) Notice: Subject to any disclaimer, the term of this patent is extended or adjusted under 35 U.S.C. 154(b) by 0 days.

(21) Appl. No.: 09/746,935

(22) Filed: Dec. 22, 2000

(65) Prior Publication Data

US 2002/0025770 A1 Feb. 28, 2002

Related U.S. Application Data

(63) Continuation-in-part of application No. 09/649,287, filed on Aug. 26, 2000.

(60) Provisional application No. 60/151,287, filed on Aug. 28, 1999.

(51) Int. Cl.[7] ..... B24D 11/00

(52) U.S. Cl. ..... 451/344; 451/354; 451/490; 451/514

(58) Field of Search ..... 451/344, 354, 451/490, 495

(56) References Cited

U.S. PATENT DOCUMENTS

| | | | | | |
|---|---|---|---|---|---|
| 470,794 | A | | 3/1892 | Shempp | |
| 1,570,177 | A | | 1/1926 | Pointer | |
| 2,154,814 | A | | 4/1939 | Hill | |
| 3,123,947 | A | * | 3/1964 | Rawley | 15/235.8 |
| 3,534,508 | A | * | 10/1970 | Delvechio | 451/296 |
| 4,944,128 | A | * | 7/1990 | Reiter | 451/495 |
| 5,203,123 | A | | 4/1993 | Travis | |
| 5,700,187 | A | * | 12/1997 | Balbi | 451/495 |
| 6,159,085 | A | * | 12/2000 | Hara | 451/344 |

* cited by examiner

*Primary Examiner*—Timothy V. Eley
*Assistant Examiner*—Alvin J. Grant
(74) *Attorney, Agent, or Firm*—John S. Reid; Reidlaw, L.L.C.

(57) ABSTRACT

An apparatus for supporting an abrasive material includes a flexible base defined by a first end and a second end, and by a lower surface which supports the abrasive material and an upper surface opposite the lower surface. The flexible base is fabricated from a resilient material so as to assume an essentially flat shape when the ends of the flexible base are not acted on by external forces. A front frame is member attached to the flexible base proximate the first end, and a rear frame member is attached to the flexible base proximate the second end. An adjustable connecting link has a first end connected to the front frame member in fixed relation thereto. A second end of the adjustable connecting link is connected to the rear frame member by a variably positionable connection.

20 Claims, 11 Drawing Sheets

SANDING BOARD HAVING CONFIGURABLE, CONTOURABLE BASE

CROSS REFERENCE TO RELATED APPLICATIONS

This application is a continuation-in-part of U.S. patent application Ser. No. 09/649,287, filed Aug. 26, 2000, which in turn claims priority to U.S. Provisional Patent Application Serial No. 60/151,287, filed Aug. 28, 1999.

FIELD OF THE INVENTION

This invention pertains to sanding boards for supporting an abrasive material, and more particularly to a sanding board having a flexible base for supporting the abrasive material, and wherein the flexible base can be configured in a contoured shape and held in the contoured shape.

BACKGROUND OF THE INVENTION

The process of "sanding" entails using an abrasive material which is adhered to a first surface to remove matter from a second surface. For example, the sanding process can be used to remove paint and other applied coatings from an object so that the object can be repainted or refinished. In other applications the sanding process can be used to remove matter from an object to shape the object into a final shape. For example, in automotive body work a weld seam between two body panels can be smoothed to give the final painted panels an integral appearance. Typically, the sanding process is performed with a sanding board or a sanding block which supports a sheet of abrasive material, such as sandpaper.

Many times the surface to be sanded is a contoured surface, and not a flat surface. However, most apparatus for performing the sanding process comprise an essentially flat base for supporting the abrasive material. When sanding a contoured surface with a flat sanding board it can be difficult to assure even coverage and produce a finished surface which does not have flat spots as a result of being sanded with the flat sanding board. Further, since only a small portion of the flat board contacts an equally small portion on a contoured surface which is being sanded, the sanding process can take a considerable period of time to complete. Accordingly, what is needed is a sanding board which can accommodate contoured surfaces to produce a smooth finished surface and which reduces the time required to perform the sanding process.

A number of prior art devices have attempted to address this problem. U.S. Pat. No. 470,794 to Shempp employs a series of stacked plates which can be moved relative to one another to attempt to match the contour of the surface being sanded. However, this device limits the contour-matching abilities of the sanding board to the thickness of the plates being used, and so a series of high point lines can result where the edges of the plates meet. U.S. Pat. No. 1,570,177 to Pointer uses a similar assembly of a plurality of plates, and therefore suffers from the same limitations as does the Shempp patent.

U.S. Pat. No. 3,1 23,947 to Rawley discloses a contourable sanding board having a flexible base, a front and a rear frame member attached respectively to the front and rear of the flexible base, and a central frame member connected to the center of the flexible base. A first turnbuckle connects the front frame member and the central frame member, and a second turnbuckle connects the rear frame member and the central frame member. By adjusting the turnbuckles the front and rear frame members can be pulled towards, or pushed away from, the central frame member. By pulling one of the end frame members towards the central frame member, the flexible base is caused to curve in a convex shape between the end and the central frame member; by pushing one of the end frame members away from the central frame member, the flexible base is caused to curve in a concave shape between the end and the central frame member.

U.S. Pat. No. 4,944,128 to Reiter attempts to address the problem by using a relatively thin, flexible sanding board to which sand paper can be attached. A secondary plate is attached to the sanding board at each end of the sanding board. Moveable wedge members are disposed between the sanding board and the secondary plate which, when moved in one direction or another, effectively shorten or lengthen the length of the secondary member with respect to the sanding board, thus pulling the sanding board into either a convex or a concave shape.

U.S. Pat. No. 5,203,123 to Travis provides for a flexible sanding board which uses a flexible main body impregnated with metal rods. The flexible body can be bent to a desired contoured shape, and will be held in this shape by the metal rods. However, if significant forces are applied to the flexible body during the sanding process, then the metal rods can be bent out of the desired shape.

U.S. Pat. No. 5,700,187 to Balbi discloses a sanding board which can be contoured to conform to a surface to be sanded. The sanding board comprises a flexible base for supporting a sheet of sanding material. Each end of the flexible base is attached to a cross journal which is configured to receive knobs having a threaded portion. A frame or guide fits over the journals, and incorporates two slots which receive the threaded portion of the knobs. Thus, the knobs can be used to tighten the frame against the journals. By moving the knobs in the slots, the journals are either pushed apart or pulled together, which has the effect of respectively pushing apart the ends of the flexible base or pulling the ends towards one another. When the ends are pushed apart, the sanding base is forced into a concave form; when the ends are pulled together, the based is forced into a convex form.

One common aspect of most of the prior art devices is that they produce a symmetrical curve, or two symmetrical curves. That is, the first half of the sanding board, when curved, produces a curve which is identical, but mirrored, as the curve in the second half of the sanding board. It is desirable to be able to configure the base of the sanding board with an asymmetrical curve since frequently surfaces such as boat hulls and automobile bodies have progressively curves surfaces. While some of the prior art devices (for example, the devices described by Rawley and Balbi) can be configured with an asymmetrical curve, this requires separate adjustment of each of the two adjustment points.

SUMMARY OF THE INVENTION

The present invention includes an apparatus for supporting an abrasive material, such as sandpaper, and allows the base which supports the abrasive material to be variably contoured to conform more nearly to a surface intended for finishing by the abrasive material.

In its most general form the invention includes a flexible base defined by a first end and a second end. The flexible base is further defined by a lower surface configured to support the abrasive material and an upper surface opposite the lower surface. The flexible base is fabricated from a resilient material so as to assume an essentially flat shape when the ends of the flexible base are not acted on by external forces. The apparatus further includes a front frame member attached to the flexible base proximate the first end, and a rear frame member attached to the flexible base proximate the second end. The apparatus has an adjustable connecting link having a first end and a second end. The first end of the adjustable link is connected to the front frame member in relatively fixed relation thereto. The second end of the adjustable link is connected to the rear frame member by a variably positionable connection.

In a first embodiment of the present invention the rear frame member of the apparatus defines a hole there through for receiving the second end of the adjustable connecting link. The hole is defined by a first side which faces in a general direction towards the front frame member, and a second side which faces in a general direction way from the front frame member. The first end of the adjustable connecting link comprises a threaded rod which is connected to the rear frame member in a variably positionable manner by a first nut and a second nut threadably mounted on the threaded rod. The first nut is adjacent the first side of the hole, and the second nut is adjacent the second side of the hole. By moving the first and second nuts in conjunction in a direction away from the front frame member, the frame members are pushed apart, forcing the flexible base into a concave position. Likewise, by moving the first and second nuts in conjunction in a direction towards the front frame member, the frame members are pulled together, forcing the flexible base into a convex position. The flexible base is held in the contoured position by the nuts on the threaded rod.

In a second embodiment of the apparatus the rear frame member defines a hole there through for receiving the second end of the adjustable connecting link. The hole is defined by a first side which faces in a general direction towards the front frame member, and a second side which faces in a general direction way from the front frame member. The second end of the adjustable comprises a rod disposed through the hole. The apparatus further comprises a release device hingedly attached to the rear frame member and facing the second side of the hole in the rear frame member. The release device has an opening disposed therein, and the rod is disposed through the opening. A spring is disposed between the rear frame member and the release device to bias the release device against the rod to arrest movement of the rod in the hole. By pushing the release device towards the second side of the hole in the rear frame member the rod is allowed to move in the hole. The front and rear frame members can then be pushed apart or drawn together to cause the flexible base to curve in a respective concave or convex shape. When the release device is released the spring biases the device into the rod, holding the rod and thus the flexible base in fixed position.

In a third embodiment of the present invention the adjustable connecting link is connected to the rear frame member in a variably positionable manner by an intermediate link. The intermediate link has a first end and a second end. The first end of the intermediate link is pivotally connected to the rear frame member, and the second end of the connecting link is pivotally connected to the intermediate link at a point distal from the first end of the intermediate link. Preferably, the point where the intermediate link is connected to the rear frame member and the point where the intermediate link is connected to the connecting link are located along an axis which is variably about 40 degrees from either side of normal to the upper surface of the flexible base. Also preferably the apparatus includes a lock device configured to fixedly secure at least one of the pivotable connection points of the intermediate link to thereby prevent rotation thereof. The locking device can be released to allow the connection point to rotate. When the locking device is released the connection point between the intermediate link and the adjustable link can be moved towards the front frame member to effectively lengthen the distance of the adjustable link and thus push the front and rear frame members apart. This in turn causes the flexible base to curve in a concave shape. The base can be held in this shape by locking the locking device. Likewise, when the locking device is released the connection point between the intermediate link and the adjustable link can be moved towards the rear frame member to effectively shorten the distance of the adjustable link and thus pull the front and rear frame members together. This in turn causes the flexible base to curve in a convex shape.

These and other aspects of the present invention will now be described in fuller detail.

DETAILED DESCRIPTION OF THE INVENTION

The present invention provides for a sanding board which can support an abrasive sanding material, such as a sheet of sand paper, on a flexible base. The flexible base an be contoured to a concave or a convex shape to more closely conform to a surface being prepared by the abrasive material. The apparatus includes a first frame member and a second frame member which are attached to opposite ends of the flexible base. An adjustable link allows the frame members to be pushed apart or pulled together, thus forcing the based into a respective concave or convex position (with respect to a flat surface which can be acted on by the abrasive material). The adjustable link can be secured in the adjusted position to hold the flexible base in the contoured shape.

Figure 1:
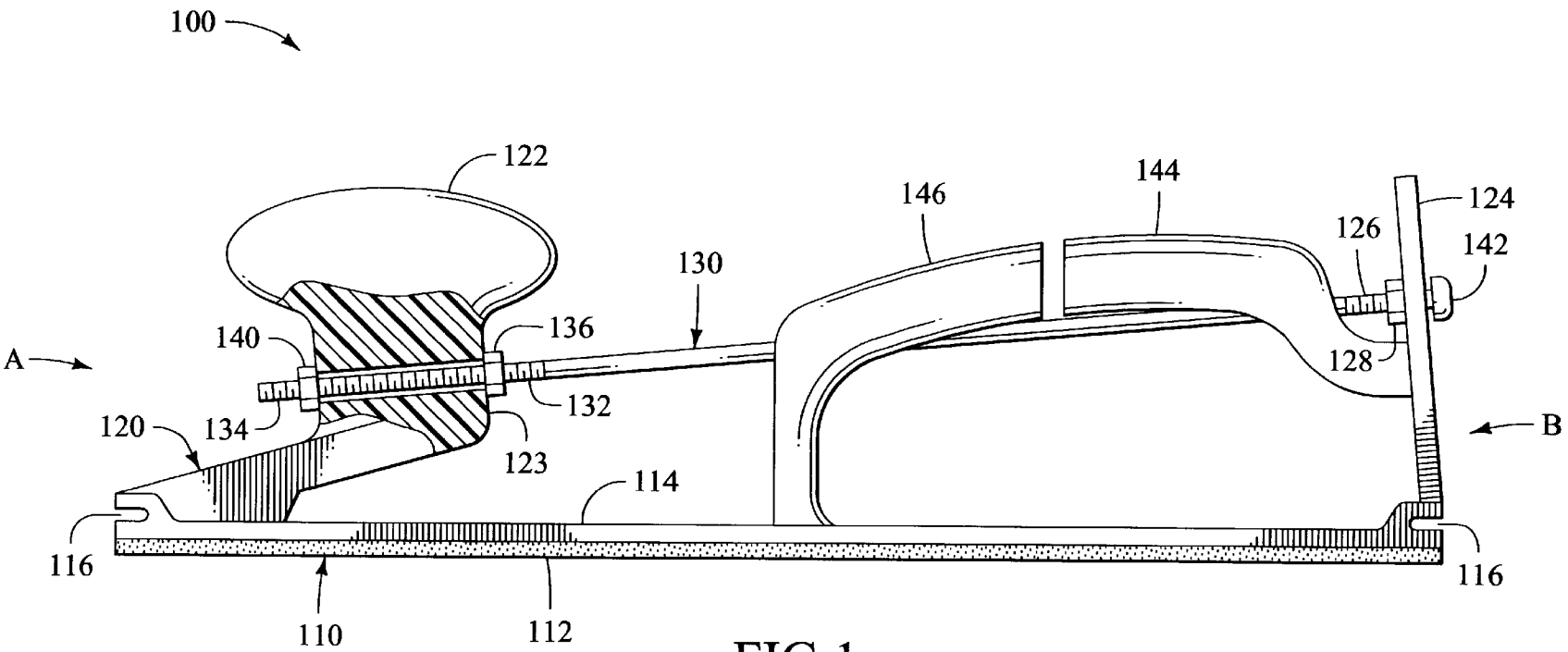
FIG. 1 is a side elevation view of a first embodiment of an apparatus in accordance with the present invention.

FIG. 1 depicts a side elevation view of a first embodiment of a sanding board 100 in accordance with the present invention. The sanding board has a flexible base 110 which is defined by a first end "A" and a second end "B", as well as a lower surface 112 and an upper surface 114. The lower surface 112 is configured to receive an abrasive material, such as a sheet of sanding paper (not shown), which can be secured to the base with grooves 116 and a locking mechanism (not shown, but known in the art) for securing ends of the sand paper into the grooves. The flexible base, in an unstressed condition, is generally flat, as depicted in FIG. 1. However, when subjected to a bending moment, the flexible base will curve either upward to a convex position (see FIG. 2), or downward to a concave position (see FIG. 3). When the bending moment is removed, the flexible base returns to its generally flat shape. Materials of construction for the flexible base preferably include a resilient material such as nylon or polypropylene. The flexible base can also be impregnated with glass fibers (such as fiberglass) to provide additional strength. The lower surface 112 of the flexible base can also be provided with a resiliently compliant material, such as a dense foam, to improve surface area contact between the abrasive material and the surface being conditioned by the abrasive material.

While the sanding base can be configured to receive sheets of abrasive medium using clamps to secure the sheet to the base in the traditional method, preferably, the sanding base is configured to receive sheets of abrasive medium using a method of attachment which allows the sheet to be adhered directly to the flexible base itself. When an end-clamp system is used and the sheet of abrasive medium is not attached directly to the lower surface of the flexible base the sheet will tend to "sag" when the flexible base is contoured to a convex shape from a flat shape. However, several methods now exist for attaching sheets of abrasive medium directly to a sanding base without the use of clamps or the like. These methods keep the sheet of abrasive medium in contact with the lower surface of the flexible base regardless of the shape assumed by the flexible base. One method which is offered by the Minnesota Mining and Manufacturing Company "3M" is known as the "Hook-It" system, and uses a sheet of abrasive medium which has a Velcro®-type surface on the lower surface of the sanding board base and a complementary surface on the abrasive medium. With this system the sheet of abrasive medium is attached merely by pressing the sheet against the lower surface of the base. The sheet of abrasive medium thus follows the lower surface of the flexible base as the flexible base is contoured to various shapes. Another system employs an adhesive which is applied to the surface of the sheet of abrasive medium opposite the side having the abrasive medium applied thereto. The adhesive allows the sheet of abrasive medium to be adhered directly to the lower surface of the flexible base. Both of these systems tend to keep the sheet of abrasive medium in contact with the lower surface of the flexible base regardless of the shape assumed by the flexible base, eliminating the "sag" problem which can occur using the older non-adhesive type sheets of abrasive medium.

In the following description it is understood that the terms "front" and "rear" as applied to ends of the sanding board, or to components connected to the sanding board, are relative terms. Thus, the expressions "front", "rear", "first" and "second" are used in conjunction with the accompanying drawings merely to facilitate the discussion of the invention. While a sanding board may be said to have a "front" end based on the types of handles which are attached to the board, or to the direction in which the board is moved during use, or to the direction in which force is applied to the board during use, the use of such an expression in the accompanying description should not be construed as strictly limiting the arrangement of parts to one end or the other of the flexible base.

Referring still to FIG. 1, the apparatus further includes a front frame member 120 which is attached to upper side 114 of the first end "A" of the flexible base 110. The apparatus further includes a rear frame member 124 which is attached to upper side 114 of the second end "B" of the flexible base 110. The frame members 120 and 124 can be integrally formed with the flexible base such as when the flexible base is an injection molded plastic component. The front and rear frame members are connected by an adjustable connecting link 130. A first end of the connecting link 130 is connected to the rear frame member 124 in relatively fixed relationship thereto. That is, the connecting link 130 does not move along the length of the connecting link relative to the rear frame member. The second end of the connecting link 130 is connected to the front frame member 120 in a variably positionable manner. It should be noted that this configuration can be reversed such that the variably positionable connection of the connecting link 130 can be made at the rear frame member 124, and the relatively fixed connection of the connecting link can be made at the front frame member 120.

The apparatus depicted in FIG. 1 can also include a first or "front" handle 122 which is attached to, or formed as part of, the front frame member 120 and can be used to facilitate the use of the apparatus. The apparatus can further include a second or "rear" handle , which is depicted here as two-part handle comprising parts 144 and 146. Part 144 is attached to the rear frame member 124, and part 146 is attached to the flexible base. The two-part configuration of the rear handle allows the flexible base to be contoured without resistance from the handle, as indicated by the separation of components 144 and 146 in FIG. 2, and the drawing-together of these components in FIG. 3. The handle components 144 and 146 can be provided with slots (not shown) to accommodate the connecting link 130.

Figure 2:
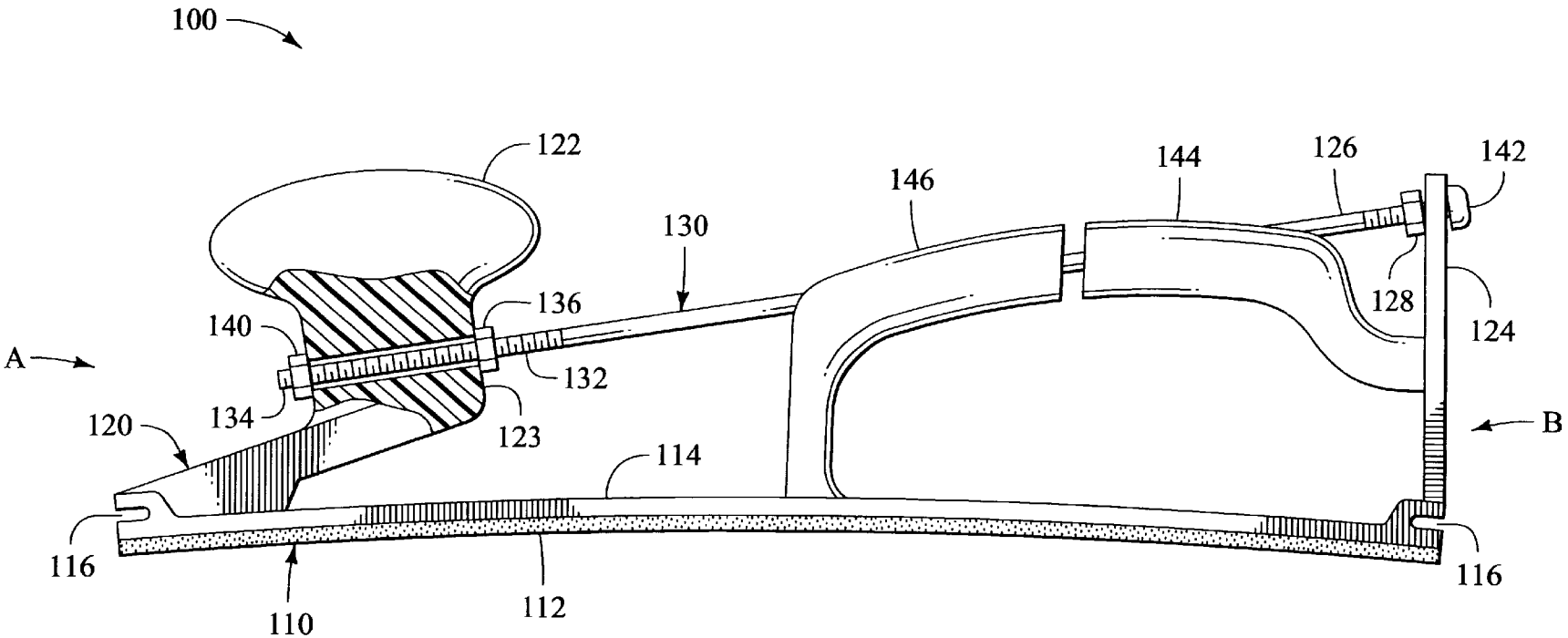
FIG. 2 shows the apparatus depicted in FIG. 1, but with the flexible base contoured in a concave shape.

As depicted in FIG. 1, the adjustable connecting link 130 comprises a rod having a threaded portion 132 at a first end of the rod. The rod can be for example a metal rod, and is preferably of a sufficiently strong material to hold the two frame members 120 and 124 in a pushed-apart relationship, as indicated by FIG. 2. The connecting link 130 is connected to the front frame member 120 in a variably positionable manner. A variably positionable connection can be achieved in a number of ways, one of which is depicted in FIG. 1. As shown, the handle portion 122 of the front frame member 124 includes a stem portion 123 which defines a hole 138. The hole is further defined by a first side which faces in a general direction towards the rear frame member 124, and a second side which faces in a general direction away from the rear frame member. A first nut 136 is mounted on the threaded portion 132 of the connecting link 130 adjacent the first side of the hole 138, and a second nut 140 is mounted on the threaded portion of the connecting link adjacent the second side of the hole 138. The stem portion 123 is thus held between the two nuts 136 and 140.

Figures 4, 5:
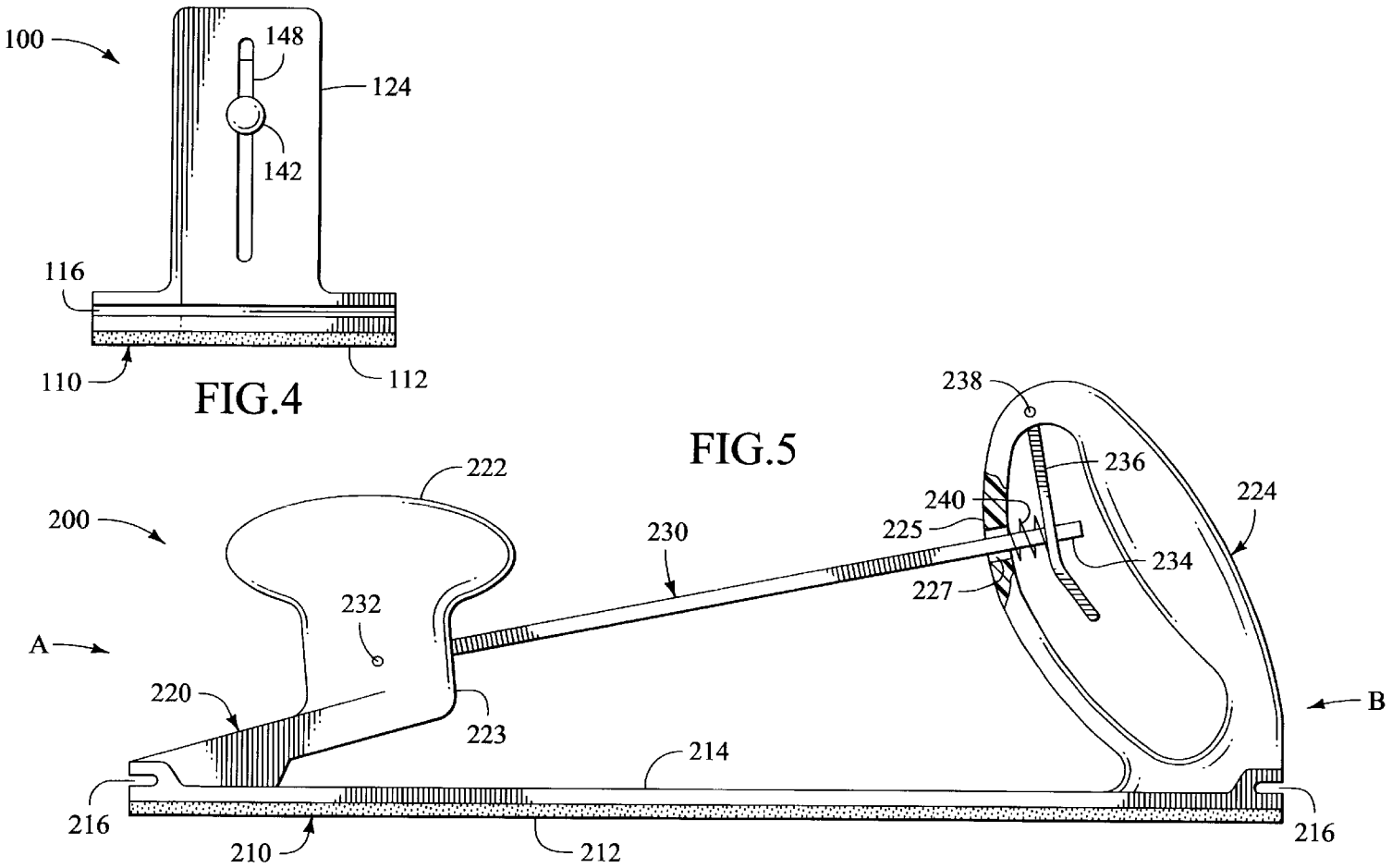
FIG. 4 is a right side elevation view of the apparatus depicted in FIG. 1.
FIG. 5 is a side elevation view of a second embodiment of an apparatus in accordance with the present invention.

The second end 126 of the connecting link 130 is held in relatively fixed position to the rear frame member 124 by nut 128 and cap 142. Preferably, the connecting link is connected to the rear frame member 124 such that the second end 126 of the connecting link can move along a path constrained by the rear frame member itself. Turning briefly to FIG. 4, a right side elevation view of the apparatus 100 of FIG. 1 is depicted. The rear frame member 124 includes an elongated slot 148 in which the connecting link 130 (FIG. 1) can move in an "up" and "down" direction relative to the flexible base 110. Returning to FIG. 1, it can be seen that the nut 128 and the cap 142 are not tightly drawn against the rear frame member 124, allowing the relatively fixed end 126 of the connecting link to move "up" and "down" in the elongated slot 148 (FIG. 4).

Figure 3:
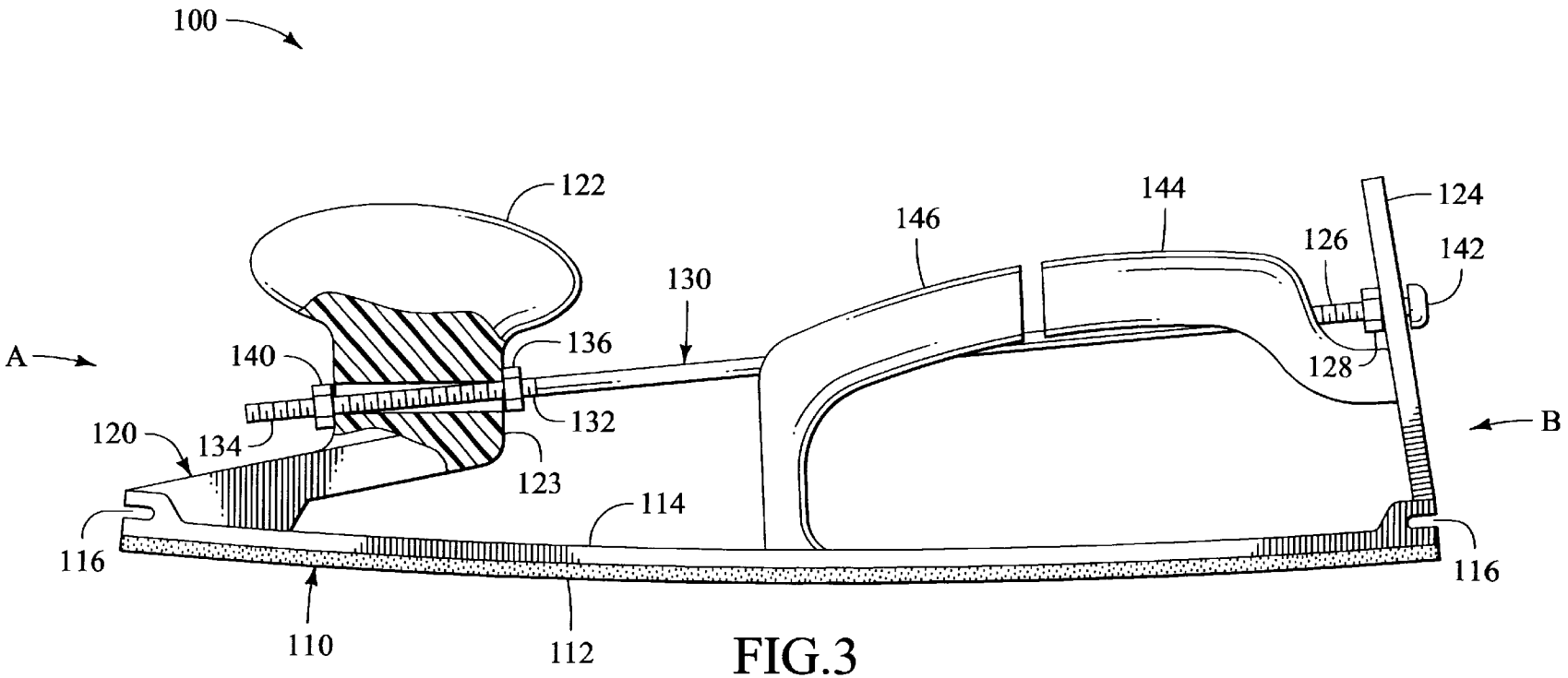
FIG. 3 shows the apparatus depicted in FIG. 1, but with the flexible base contoured in a convex shape.

In operation, the first end 134 of the connecting link 130 is variably positionable in the front frame member 120 by moving the nuts 140 and 136 along the threaded portion 132 of the connecting link. As the nuts 140 and 136 are moved towards the end 134 of the connecting link 130, the first nut 136 pushes against the stem 123, and the nut 128 is pushed against the rear frame member 124, pushing the front frame member 120 and the rear frame member 124 apart. This causes the flexible base 110 to curve "upwards" into a concave shape, as depicted in FIG. 2. Likewise, as the nuts 140 and 136 are moved away from the end 134 of the connecting link 130, the second nut 140 pushes against the stem 123, and the cap 142 is pushed against the rear frame member 124, pulling the front frame member 120 and the rear frame member 124 together. This causes the flexible base 110 to curve "downwards" into a convex shape, as depicted in FIG. 3. The nuts 140, 136 and 128, and cap 124, thus act to hold the frame members 120 and 124 in a pushed-apart or a pulled-together relationship, thus maintaining the flexible base 110 in the achieved contoured position. The amount of contour achieved by the flexible base 110 can be varied by varying the positions of the nuts 140 and 136 along the threaded portion 132 of the adjustable connecting link 130.

Turning now to FIG. 5, a second embodiment of the present invention is depicted is a side elevation view. The primary difference between the first embodiment depicted in FIGS. 1–4 and the embodiment of FIG. 5 is the manner in which the variably positionable connection of the adjustable connecting link is achieved. In addition, whereas the apparatus of FIG. 1 has the variably positionable end of the connecting link 130 located at the front frame member 120, in FIG. 5 the variably positionable end of the connecting link 230 is located at the rear frame member 224. However, as discussed earlier, the location of the variably positionable connection is not critical to the invention.

The apparatus 200 of FIG. 5 includes a flexible base 210 which is similar to the base 110 of FIG. 1. The base 210 is defined by a first end "A", a second end "B", and defines a lower surface 212 for supporting an abrasive sanding material, and an opposite upper surface 214. A front or first frame member 220 is attached to the first end "A" of the flexible base 110, and a rear or second frame member is attached to the second end "B" of the flexible base. As with the frame members 120 and 124 of FIG. 1, the frame members 220 and 224 of FIG. 5 can be integrally formed with the flexible base. The front frame member 220 can further include a handle 222. The rear frame member 224 can be formed in the shape of a handle, as indicated in the drawing.

The apparatus 200 also includes an adjustable connecting link 230 which is connected at a first end to the front frame member 220 in a relatively fixed position by pin 232. Preferably, stem 223 defines an opening (not shown) which allows the connecting link 230 to rotate slightly in a clockwise and a counter-clockwise direction about pin 232. This ability to rotate slightly allows the connecting link to accommodate movement of the flexible base in the same manner that the elongated slot 148 in the rear frame member 124 allowed the connecting link to accommodate flexure of the base 110 in the apparatus 100 (FIG. 4). The adjustable connecting link 230 of FIG. 5 can be a metal rod or the like. When the release device 236 (described below) is used with the apparatus 200, the connecting rod 230 is preferably a polygonal sided rod, such as a square rod or a hexagonal rod. Also preferably, the connecting link should be fabricated from a material such as metal to resist buckling forces when pushing apart the frame members 220 and 224 (see FIG. 7 and further description below).

As depicted in FIG. 5, the adjustable connecting link 230 is connected to the rear frame member 224 in a variably positionable manner which differs from that depicted for the apparatus 100 of FIG. 1. In FIG. 5 the connecting link is slidably mounted to the rear frame member 224 and is held in a selected fixed position via a release device 236. The release device can release the connecting link from being held in a secure position to allow the connecting link to move slidably and thus be variably positionable with respect to the rear frame member 224. More specifically, the rear frame member is formed in the shape of a handle, and includes a forward portion 225 which has a hole 227 disposed therein. The hole 227 defines a first side which faces generally towards the front frame member 220, and a second side which faces generally away from the from frame member. The second end 234 of the connecting link 230 is disposed through the hole 227 in the rear frame member 224. The release device 236 is hingedly connected to the rear frame member 224 by pin 238. The release device also has a hole or opening (not shown) disposed therein, allowing the second end 234 of the connecting link 230 to pass there through. Disposed between the second side of the hole 227 and the release device 236 is a spring 240 which biases the release device 236 towards the second end "B" of the sanding board 200. Thus, the spring causes the edge of the hole in the release device to be forced against the connecting link 230, thus arresting the connecting link in its position with respect to the rear frame member 224. When the connecting link 230 is a rod having a polygonal cross section the edges of the hole in the release device 236 will engage the connecting link at the junctions of the polygonal sides, allowing the release device to achieve a more affirmative engagement with the connecting link.

Figure 6:
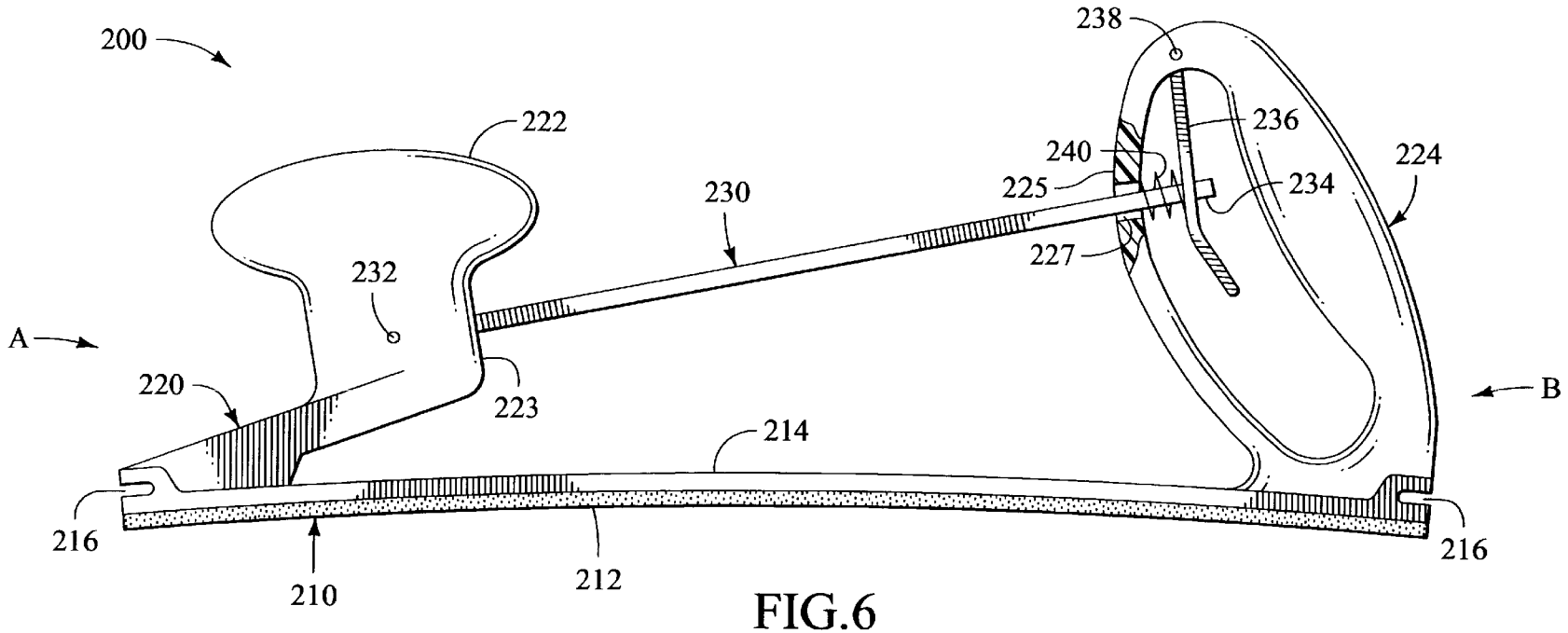
FIG. 6 shows the apparatus depicted in FIG. 5, but with the flexible base contoured in a concave shape.
Figure 7:
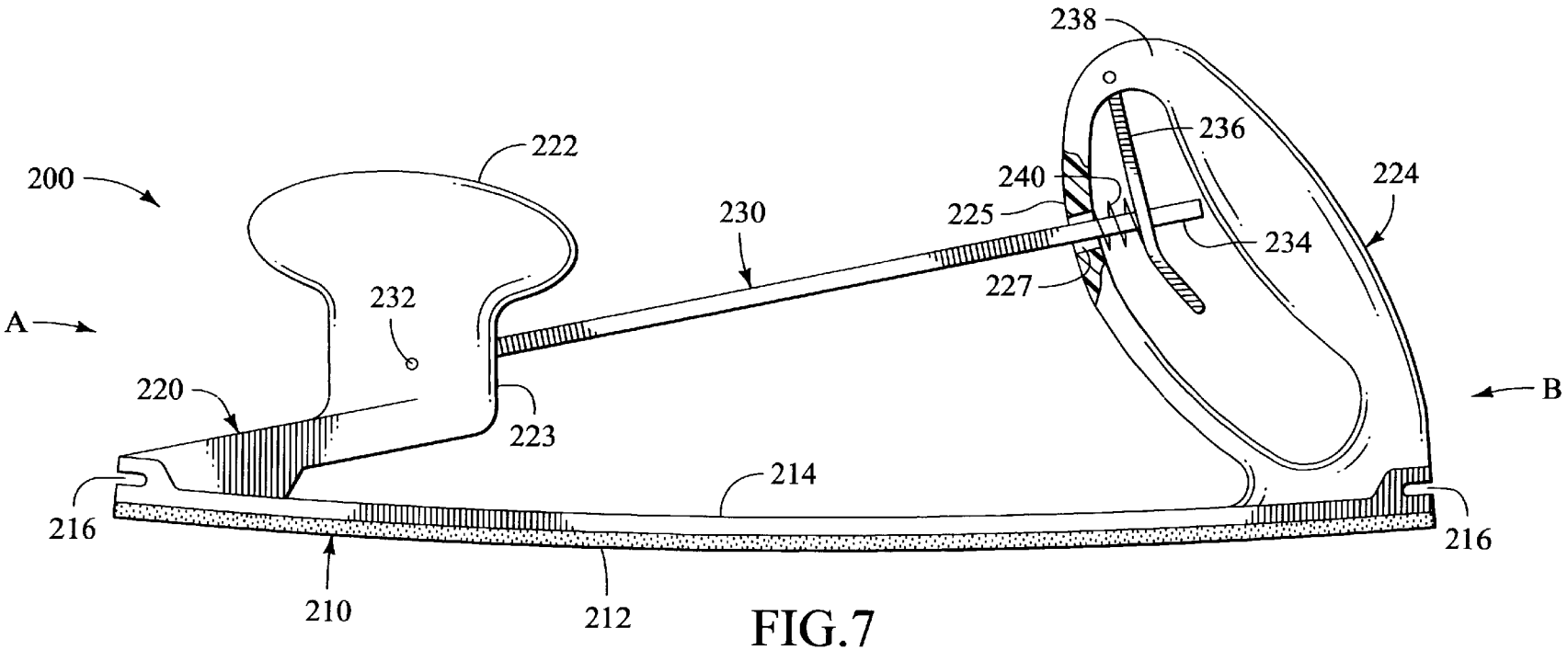
FIG. 7 shows the apparatus depicted in FIG. 5, but with the flexible base contoured in a convex shape.

In operation, a user can squeeze the release device 236 towards the front portion 225 of the rear frame member 224, thus allowing the connecting link 230 to move freely in the hole 227 in the rear frame member. The front frame member 220 and the rear frame member 224 can then be pushed apart, forcing the flexible base into a concave shape as depicted in FIG. 6. Likewise, when the release mechanism is positioned to allow free movement of the connecting link, the front frame member 220 and the rear frame member 224 can then be pulled together, forcing the flexible base into a convex shape as depicted in FIG. 7. When the user releases the release device 236 the spring 240 pushes the release device against the connecting link 230, arresting movement of the connecting link with respect to the rear frame member 224, thus holding the flexible base in the selected contoured position.

Figure 8:
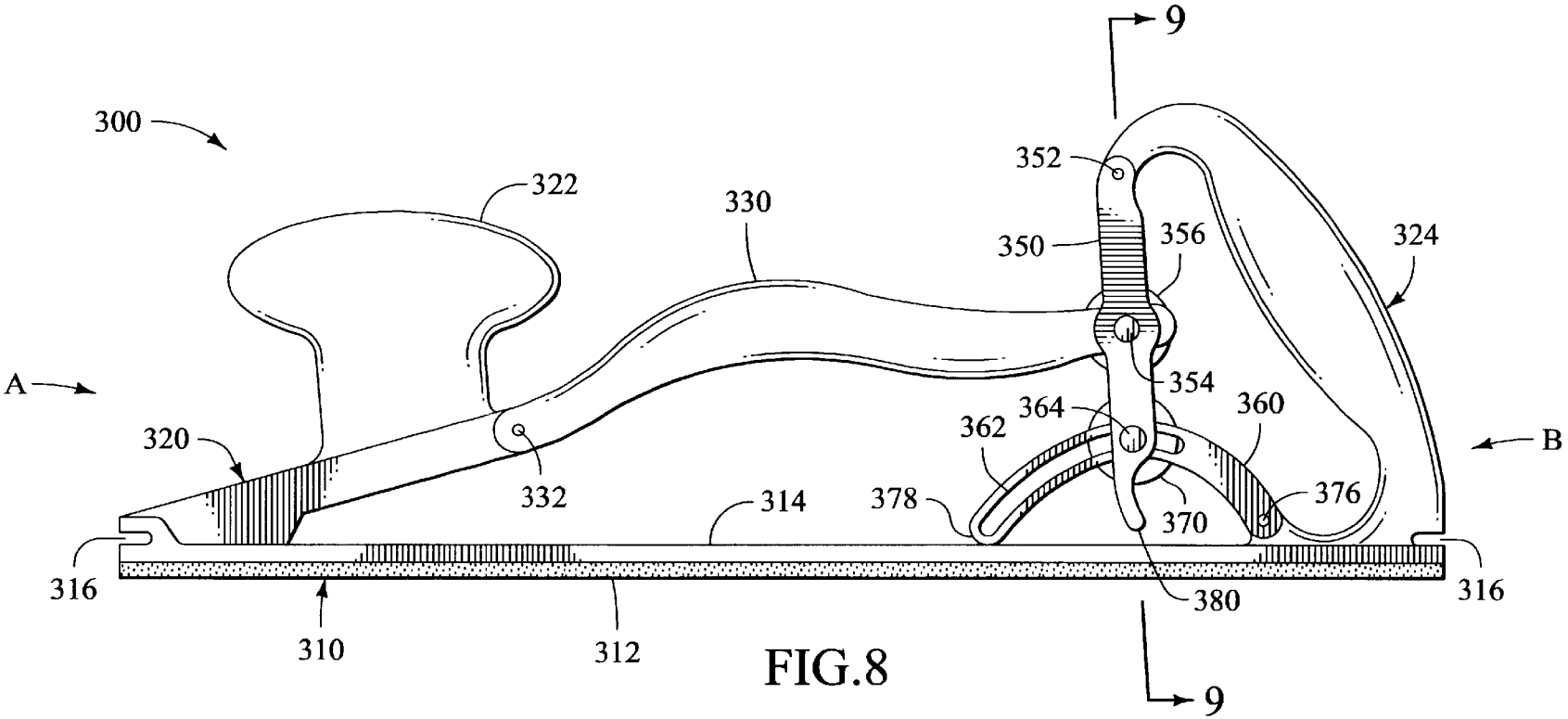
FIG. 8 is a side elevation view of a third embodiment of an apparatus in accordance with the present invention.

Turning now to FIG. 8, a third embodiment of the present invention is depicted in a side elevation view. The apparatus 300 of FIG. 8 differs from that of the previous two embodiments (apparatus 100 and 200 of respective FIGS. 1 and 5) in that the variably positionable connection is achieved by use of an intermediate link, as will be more fully described below. The apparatus includes a flexible base 310 which defines a first end "A" of the sanding board 300, and a second end "B" of the sanding board. The flexible base 310 is defined by a lower surface 312 which is configured to support an abrasive material, and an opposite upper surface 314. The flexible base 310 is configured similar to the flexible base 110 of the apparatus 100 of FIG. 1 and the flexible base 210 of the apparatus 200 of FIG. 5. That is, the flexible base 310 is fabricated from a resilient flexible material allowing the base 310 to be reconfigured to a contoured shape, yet return to an essentially flat position when not acted on by external forces.

The sanding board 300 further comprises a front frame member 320 which is connected to the first end "A" of the flexible base 310, and a rear frame member 324 which is connected to the second end "B" of the flexible base. The front frame member 320 can include a first handle portion 322, and the rear frame member 324 can be formed in the shape of a second handle. The apparatus 300 further includes an adjustable connecting link 330 which is pivotally attached to the front frame member 320 by pin 332 to establish a relatively fixed position of the connecting link with the front frame member. The apparatus further includes an intermediate link 350. The intermediate link 350 is pivotally connected to the rear frame member 324 at a first end of the intermediate link by a connecting pin 352. The intermediate link 350 is further pivotally connected to the connecting link 320 at a second end of the intermediate link (or at a point along the intermediate link distal from the first end) by a connecting pin 354. The intermediate link forms the variably positionable connection between the rear frame member 324 and the connecting link 330. Preferably, the intermediate link 350 is positioned such that the connecting pins 352 and 354 are aligned along an axis which is variably positionable from about plus or minus 40 degrees from normal to the flexible base 310. This allows the connecting pin 354 to be moved towards the first end "A" or the second end "B" of the flexible base 310, thus causing the effective length of the connecting link 330 to be increased or decreased. This in turn causes the front frame member 320 to be respectively pushed away from or pulled towards the rear frame member 324, which in turn causes the flexible base 310 to be forced into the respective concave or convex shapes depicted in respective FIGS. 10 and 11.

The apparatus 300 of FIG. 5 can further include a guide link 360 which is used to guide the second end of the intermediate link 350. The guide link is pivotally attached at a first end to the flexible base by a pin 376. When the guide link 360 is employed the second end of the intermediate link 350 is extended to allow the intermediate link to be connected to the guide link by a guide pin 364. The guide link is generally curved in shape and is attached to the flexible base 310 such that the curved shape is concave to the upper surface 314 of the flexible base 310. The guide link 360 defines an elongated slot 362 which receives the guide pin 364, constraining movement of the guide pin 364 to the elongated slot 362 as the second end of the intermediate link 350 is moved towards or away from the front frame member 320.

Figures 9, 10:
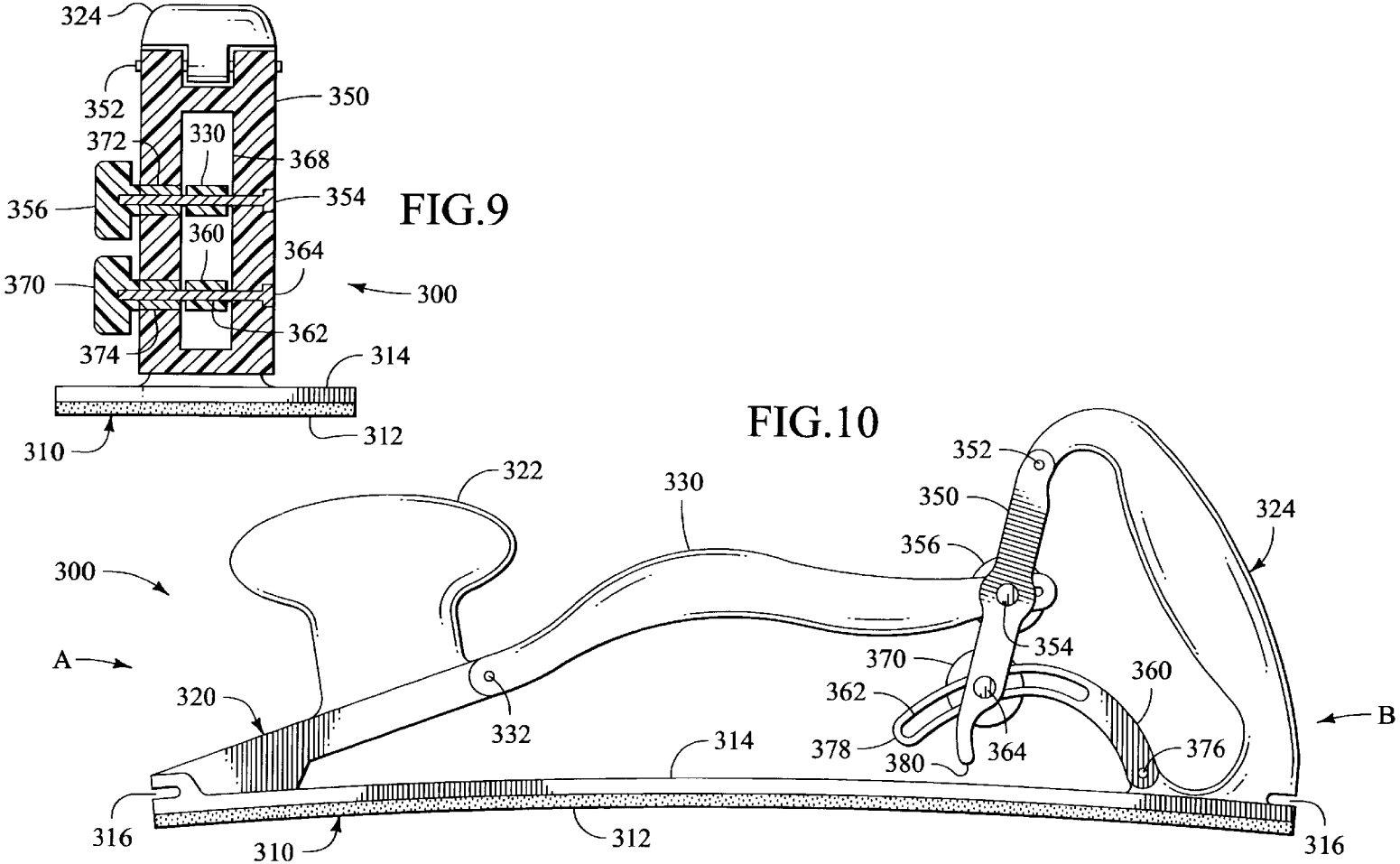
FIG. 9 is a side elevation sectional view of the apparatus depicted in FIG. 8.
FIG. 10 shows the apparatus depicted in FIG. 8, but with the flexible base contoured in a concave shape.
Figure 11:
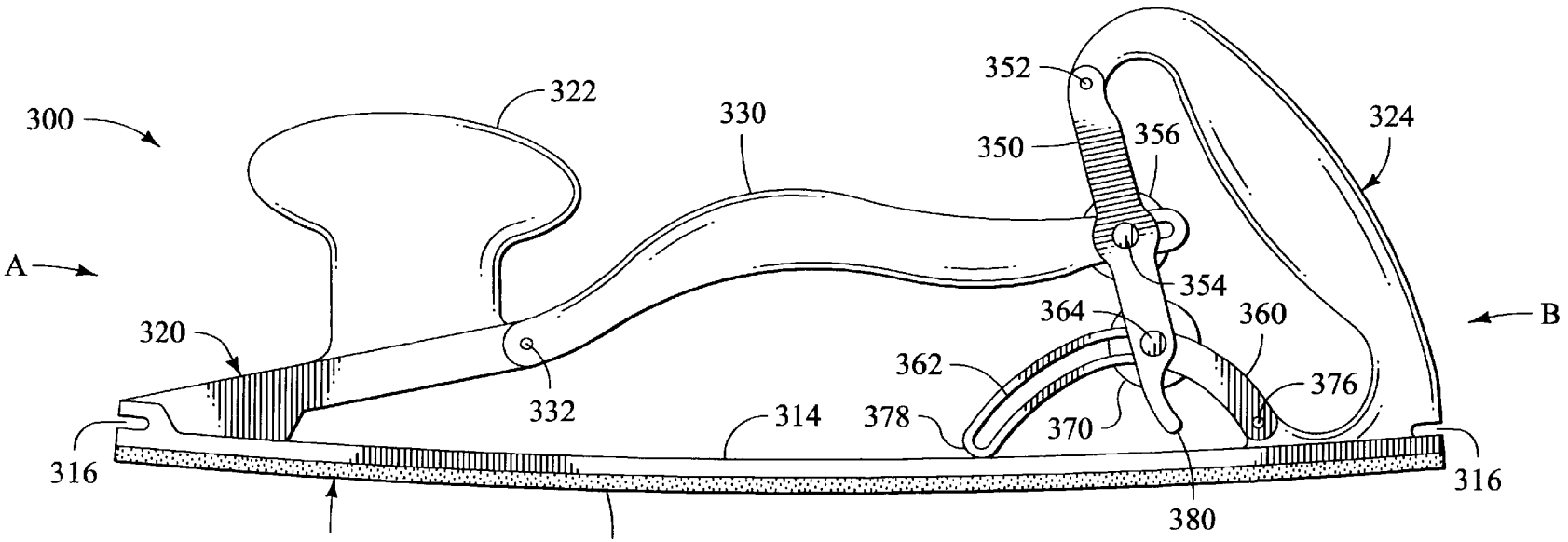
FIG. 11 shows the apparatus depicted in FIG. 8, but with the flexible base contoured in a convex shape.

FIG. 9 depicts a sectional view of the sanding board 300 of FIG. 8. The sectional view of FIG. 9 is a side sectional view drawn along a line connecting the connecting pins 352 and 354, and the guide pin 364. As shown, the intermediate link 350 has a slotted opening 368 which receives the second end of the connecting link 330. The intermediate link 350 can be secured to the connecting link 330 in a selected fixed position by a first lock. As depicted, the first locking device comprises a knob 356 which is threadably engaged with the connecting pin 354. The first locking device further includes a bushing 372 which is fitted within a recess in the intermediate member 350. By turning the knob 356 in a first direction the bushing 372 can be forced into contact with the connecting link 330 to thus secure the intermediate link 350 to the connecting link, preventing relative movement there between. Likewise, by turning the knob 356 in an opposite direction the bushing 372 can be relieved from contact with the connecting link 330 to thus allow relative movement between the intermediate link 350 and the connecting link 330.

In a like manner the intermediate link 350 can be secured to the guide link 360 in a selected fixed position by a second lock. As depicted, the second locking device comprises a knob 370 which is threadably engaged with the guide pin 364. The second locking device further includes a bushing 374 which is fitted within a recess in the intermediate member 350. By turning the knob 370 in a first direction the bushing 374 can be forced into contact with the guide link 330 to thus secure the intermediate link 350 to the guide link, preventing relative movement there between. Likewise, by turning the knob 370 in an opposite direction the bushing 374 can be relieved from contact with the guide link 360 to thus allow relative movement between the intermediate link 350 and the guide link.

An additional advantage obtained by use of the guide link 360 is that the first locking device (enabled by locking knob 356) can be enabled to secure the second end of the connecting link 330 to the intermediate link 350, while the second locking device (enabled by locking knob 370) can be disabled to allow relative movement between the guide link 360 and the intermediate link 350. This allows a limited amount of flexibility in the flexible base 310, which can be desirable to allow the flexible base to dynamically contour to a surface being conditioned by the abrasive medium.

The apparatus 300 is operated as follows. The locking devices (described above) are released allowing the intermediate link 350 to move freely with respect to both the connecting link 330 and the guide link 360. By squeezing together the distal end 380 of the intermediate link 350 and the second end 378 of the guide link 360 the guide pin 364 is moved along the elongated slot 362, causing the connecting pin 354 to draw the second end of the connecting link 330 towards the rear frame member 324. This causes the flexible base to be configured in the concave shape depicted in FIG. 10. Likewise, by pushing apart the distal end 380 of the intermediate link 350 and the second end 378 of the guide link 360 the guide pin 364 is moved along the elongated slot 362, causing the connecting pin 354 to move the second end of the connecting link 330 away from the rear frame member 324. This causes the flexible base to be configured in the convex shape depicted in FIG. 11.

An advantageous feature of the apparatus of the present invention is that when the apparatus is operated to curve the sanding board the resultant curvature of the sanding board is an offset-center curve, i.e., an asymmetrical or progressive curve. This can be seen by viewing FIG. 10, wherein the portion of the flexible base 310 which is closer to the first end "A" has a greater curvature than the portion of the flexible base near the second end "B". This results from the fact that the sanding board has one end of the adjustable connecting link 430 which is relatively fixed with respect to a first frame (here, 420) attached to the flexible base, while the other end of the connecting link is connected via a positionable connection to a second frame (here, 424) attached to the flexible base.

Figure 12:
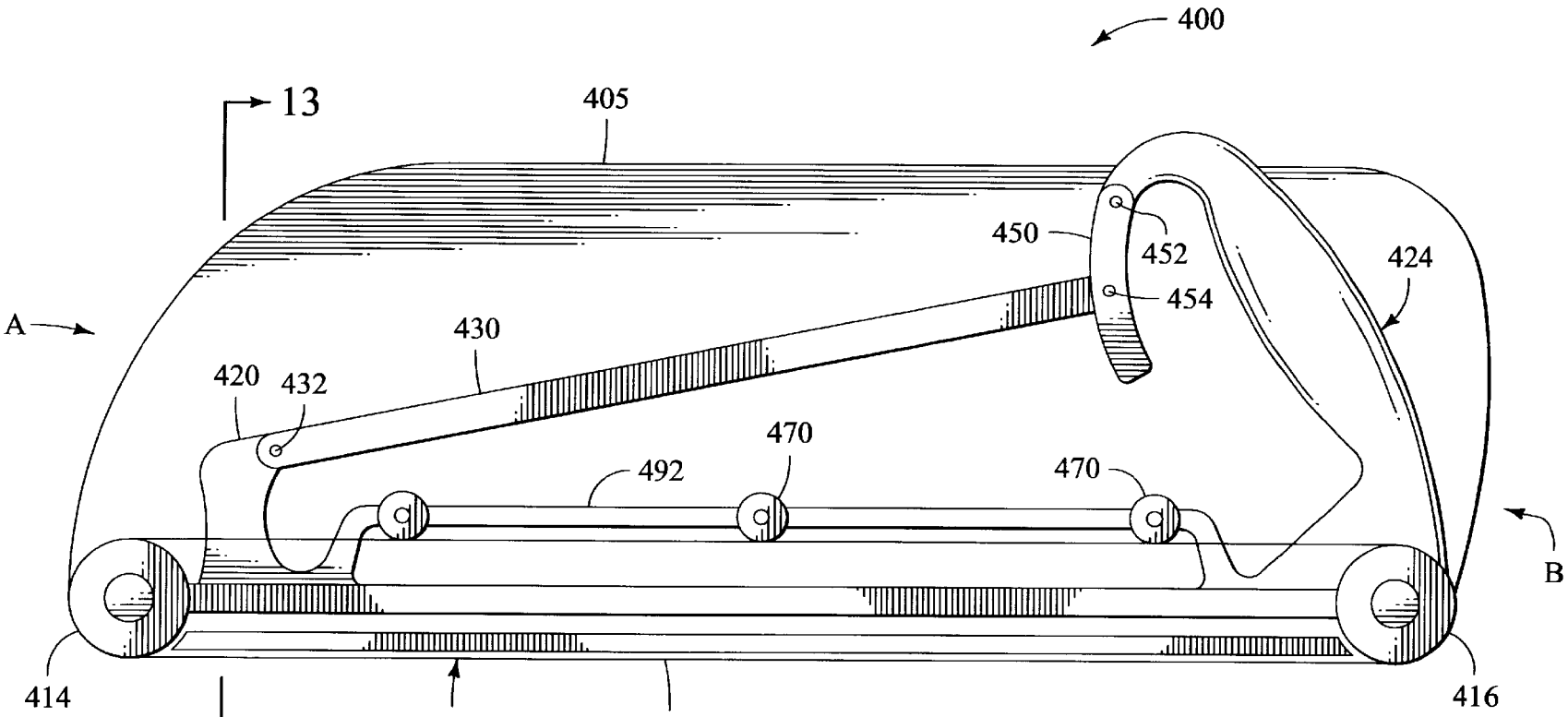
FIG. 12 is a side elevation view of a fourth embodiment of an apparatus in accordance with the present invention.
Figure 13:
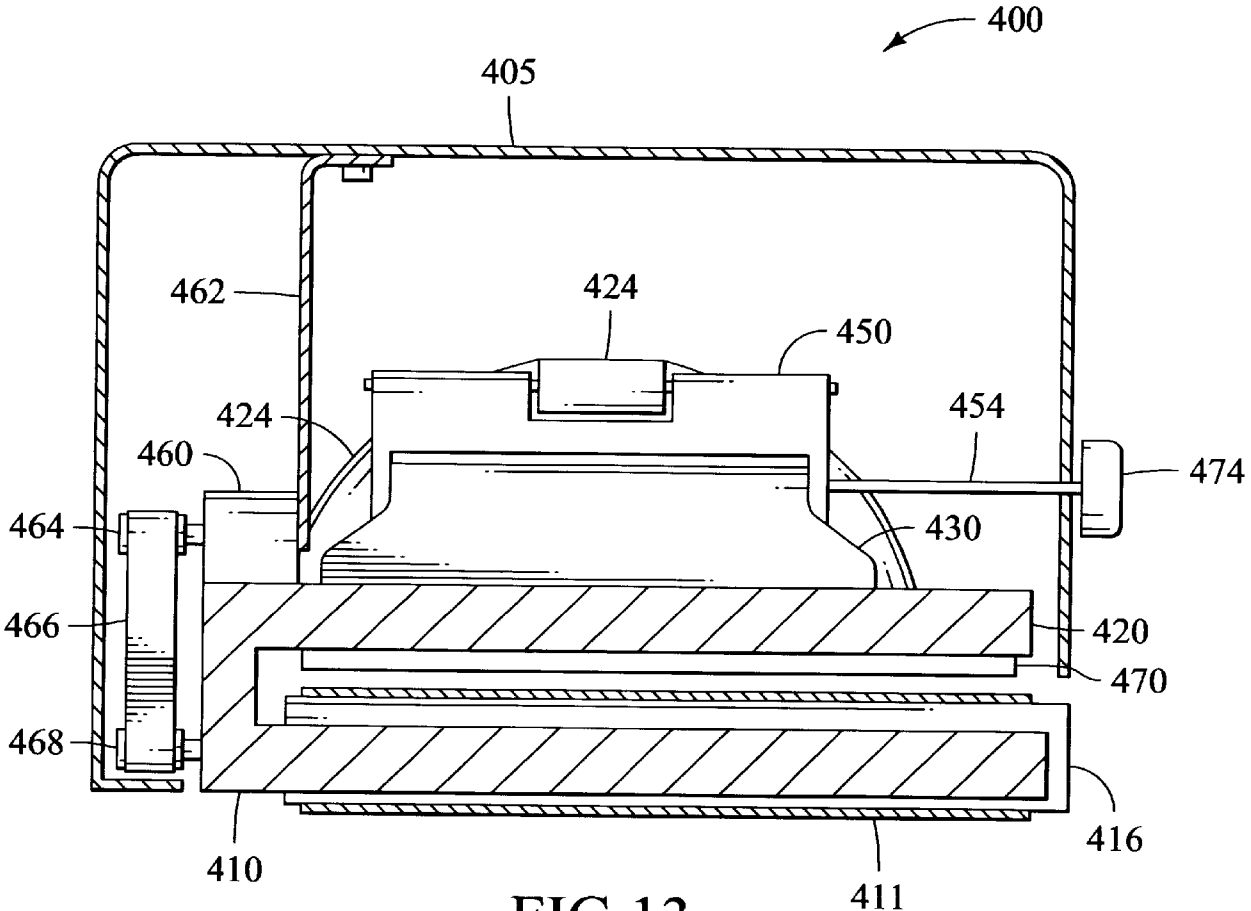
FIG. 13 is a side elevation sectional view of the apparatus depicted in FIG. 12.

Turning now to FIG. 12 a fourth embodiment of the present invention is depicted in a side elevation view. The apparatus 400 of FIG. 12 is essentially a power sander version of the apparatus 300 of FIG. 8. The apparatus 400 is configured to receive a piece of continuous medium 411 supporting an abrasive material, which may be described as a "sanding belt". The apparatus 400 includes a flexible base 410 which defines a first end "A" and a second end "B" of the apparatus. The flexible base 410 is defined by a lower surface which provides support for the continuous medium 411. The apparatus 400 further include a front frame member 420 and a rear frame member 424. The frame members are attached to the side of the flexible base 410 in a sideways "U" shape (as depicted in FIG. 13) to allow the sanding belt 411 to be applied to and removed from the flexible base 410. The apparatus 400 preferably includes a housing 405 which encloses the components of the apparatus 400.

The apparatus 400 of FIGS. 12 and 13 further includes a first roller 414 which is supported at the first end "A" of the flexible base, and a second roller 416 which is supported at the second end "B" of the flexible base. At least one of the rollers 414 and 416 is connected to a motor which drives the roller, thus causing the continuous medium 411 to rotate about the flexible base 410. As depicted in FIG. 13, which is a side sectional view of the apparatus 400 of FIG. 12, the drive motor 460 drives a first pulley 464 which in turn drives a second pulley 468 via a belt 466. The second pulley 468 is connected to the second roller 416, so that the motor causes the second roller to rotate, moving the continuous medium 411 past the flexible base 410. Preferably, the motor 460 causes the second roller 416 to move in a counter-clockwise direction (as viewed in FIG. 12) to thus pull the continuous medium over the lower surface of the flexible base 410 in a direction towards the rear frame member 424. The motor 460 can be supported from the housing 405 by a bracket 462. In like manner the flexible base 410 and the frame members 420 and 424 can be supported by the housing 405, although the connections between the frame members and the housing should allow at least one of the frame members to be capable of movement with respect to the housing to allow the flexible base to be configured in a contoured position.

The apparatus 400 further includes an adjustable connecting link 430 which is pivotally connected to the front frame member 420 in a relatively fixed position by connecting pin 432. Similar to the apparatus 300 of FIG. 8, the apparatus 400 also incorporates an intermediate link 450 is pivotally connected at a first end to the rear frame ember 424 by a connecting pin 452, and is pivotally connected at a second end to the connecting link 430 by connecting pin 454. The embodiment depicted in FIG. 12 does not include a guide link such as guide link 360 of FIG. 8, although such a guide link can be incorporated in the apparatus 400 if desired. The intermediate link 450 can be secured to the connecting link 430 in a selected position using a lock device. As depicted in FIG. 13 the lock device uses a knob 474 to push the sides of the intermediate link 450 into contact with the sides of the connecting link 430 via shaft 454 in a manner similar to that described with respect the first locking device in FIG. 9, which uses knob 356 and bushing 372. The shaft 454 can fit within a slot (not shown) in the housing 405, allowing a user to use the knob 472 to move the intermediate link 450 and thus reconfigure the contour of the flexible base.

The apparatus 400 as depicted in FIG. 12 preferably includes one or more intermediate rollers 470 which are positioned above the piece of continuous medium 411 at the upper side of the flexible base 410. The rollers can be supported by a flexible roller support frame 492 which is connected to the flexible base 410. Thus, when the flexible base 410 is shaped to a contoured shape, the rollers 470 will follow the shape and will cause the upper surface of the continuous medium 411 to be constrained to the shape of the flexible base 410. The rollers 470 can also be replaced with a flexible surface which performs the same function.

Preferably, in each of the embodiments depicted in FIGS. 1, 5, 8 and 12 the frame member which is connected to the connecting link at the relatively fixed position is connected to the flexible base to allow flexure between the frame member and the flexible base. This allows the flexible base to more easily conform to a contoured shape when the variably positionable connection is actuated to cause the flexible base to form the contoured shape.

It is understood that the locking devices described for the third embodiment depicted in FIG. 8, and the locking device depicted in FIG. 13, can be any device which can be actuated to prevent relative movement of the intermediate link 350, 450 with respect to the connecting link 330, 430.

The invention further includes a method of contouring an abrasive medium to generally conform to a surface to be finished by the abrasive medium. The method includes the steps of providing a flexible base defined by a first end and a second end, and providing an adjustable connecting link. The first end and the second end of the flexible base are connected using the adjustable connecting link, and the abrasive medium is supported on the flexible base. One end of the flexible base is moved with respect to the adjustable connecting link while holding the other end of the flexible base stationary with respect to the adjustable connecting link. This causes the flexible base to shape into a contoured position. The end of the flexible base which was moved with respect to the adjustable connecting link is then secured with respect to that end of the connecting link to thereby hold the flexible base in the contoured position.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An apparatus for supporting an abrasive material comprising:

a flexible base defined by a first end and a second end, the flexible base further defined by a lower surface configured to support the abrasive material and an upper surface opposite the lower surface, and wherein the flexible base is fabricated from a resilient material so as to assume an essentially flat shape when the ends of the flexible base are not acted on by external forces;

a front frame member attached to the flexible base proximate the first end;

a rear frame member attached to the flexible base proximate the second end; and an adjustable connecting link having a first end and a second end, the first end being connected to the front frame member in relatively fixed, non-adjustable relation thereto, and the second end being connected to the rear frame member by a variably positionable connection.

2. The apparatus of claim 1, and wherein:

the rear frame member defines a hole there through for receiving the second end of the adjustable connecting link, the hole being defined by a first side which faces in a general direction towards the front frame member, and a second side which faces in a general direction way from the front frame member;

the second end of the adjustable link comprises a threaded rod; and the variably positionable connection comprises a first nut and a second nut threadably mounted on the threaded rod, the first nut being adjacent the first side of the hole, and the second nut being adjacent the second side of the hole.

3. The apparatus of claim 1, and wherein:

the rear frame member defines a hole there through for receiving the second end of the adjustable connecting link, the hole being defined by a first side which faces in a general direction towards the front frame member, and a second side which faces in a general direction way from the front frame member;

the second end of the adjustable connecting link comprises a rod disposed through the hole; and the variably positionable connection comprises:

a release device hingedly attached to the rear frame member and facing the second side of the hole in the rear frame member, the release device having an opening disposed therein, the rod being disposed through the opening; and a spring disposed between the rear frame member and the release device to bias the release device against the rod to arrest movement of the rod in the hole.

4. The apparatus of claim 1, and wherein the variably positionable connection comprises an intermediate link having a first end and a second end, the first end of the intermediate link being pivotally connected to the rear frame member, and the second end of the connecting link being pivotally connected to the intermediate link at a point distal from the first end of the intermediate link.

5. The apparatus of claim 4, and further comprising a guide link, the guide link being an elongated, generally curved member pivotally connected to the flexible base proximate the rear frame member at a first end of the guide link, and wherein the guide link defines an elongated slot, the apparatus further comprising a guide pin connecting the second end of the intermediate link to the elongated slot to allow the second end of the intermediate link to move along a path defined by the elongated slot.

6. The apparatus of claim 4, and further comprising a lock device to secure the second end of the connecting link to the intermediate link in a fixed position.

7. The apparatus of claim 5, and further comprising:

a first lock device to secure the second end of the connecting link to the intermediate link in a fixed position; and a second lock device to secure the second end of the intermediate link to the guide link in a fixed position.

8. The apparatus of claim 4, and wherein first end of the adjustable connecting link is pivotally connected to the front frame member.

9. The apparatus of claim 1, and wherein the front frame member forms a first handle.

10. The apparatus of claim 9, and wherein the rear frame member forms a second handle.

11. The apparatus of claim 1, and wherein the rear frame member forms a handle.

12. The apparatus of claim 1, and wherein the flexible base is fabricated from a material comprising one of nylon or polypropylene.

13. The apparatus of claim 1, and wherein the flexible base is fabricated from a material comprising glass fibers.

14. The apparatus of claim 1, and further comprising:

a first roller connected to the first end of the flexible base, and a second roller connected to the second end of the flexible base; and a drive motor configured to drive the second roller.

15. The apparatus of claim 14, and further comprising an intermediate roller connected to the flexible base and positioned proximate to the upper surface of the flexible base.

16. The apparatus of claim 15, and wherein the flexible base is configured to support a piece of continuous medium supporting an abrasive material, and further wherein the second roller is configured to cause the piece of continuous medium to rotate about the flexible base when the second roller is driven by the motor.

17. An apparatus for supporting an abrasive material comprising:

a flexible base defined by a first end and a second end, the flexible base further defined by a lower surface configured to support the abrasive material and an upper surface opposite the lower surface;

a front frame member attached to the flexible base proximate the first end;

a rear frame member attached to the flexible base proximate the second end;

an adjustable connecting link having a first end and a second end, the first end being pivotally connected to the front frame member;

an intermediate link having a first end and a second end, the first end of the intermediate link being pivotally connected to the rear frame member at a rear hinge point, and the second end of the connecting link being pivotally connected to the intermediate link at an intermediate hinge point distal from the first end of the intermediate link; and wherein the rear hinge point and the intermediate hinge point are located along an axis which is variably about 40 degrees from either side of normal to the upper surface of the flexible base.

18. The apparatus of claim 17, and further comprising a guide link comprising an elongated, generally curved member pivotally connected to the flexible base at a first end of the guide link such that the guide link is generally concave with respect to the upper surface of the flexible base, and wherein the guide link defines an elongated slot, the apparatus further comprising a guide pin connecting the second end of the intermediate link to the elongated slot to allow the second end of the intermediate link to move along a path defined by the elongated slot.

19. The apparatus of claim 18, and further comprising:

a first lock device to secure the second end of the connecting link to the intermediate link in a fixed position; and a second lock device to secure the second end of the intermediate link to the guide link in a fixed position.

20. The apparatus of claim 17, and further comprising:

a first roller connected to the first end of the flexible base, and a second roller connected to the second end of the flexible base; and a drive motor configured to drive the second roller.

* * * * *